US010981028B2

(12) United States Patent
Li

(10) Patent No.: US 10,981,028 B2
(45) Date of Patent: Apr. 20, 2021

(54) MASSAGE AND STRETCH BENCH

(71) Applicant: Lien-Tsung Li, Taichung (TW)

(72) Inventor: Lien-Tsung Li, Taichung (TW)

( * ) Notice: Subject to any disclaimer, the term of this patent is extended or adjusted under 35 U.S.C. 154(b) by 726 days.

(21) Appl. No.: 15/884,405

(22) Filed: Jan. 31, 2018

(65) Prior Publication Data

US 2019/0232098 A1 Aug. 1, 2019

(51) Int. Cl.

| | |
|---|---|
| ***A61H 1/02*** | (2006.01) |
| ***A63B 21/00*** | (2006.01) |
| ***A61H 7/00*** | (2006.01) |

(52) U.S. Cl.

CPC ..... *A63B 21/00178* (2013.01); *A61H 1/0222* (2013.01); *A61H 1/0237* (2013.01); *A61H 1/0292* (2013.01); *A61H 1/0296* (2013.01); *A61H 7/002* (2013.01); *A61H 2201/1261* (2013.01); *A61H 2201/1269* (2013.01); *A61H 2201/164* (2013.01); *A61H 2201/1623* (2013.01); *A61H 2205/04* (2013.01); *A61H 2205/081* (2013.01)

(58) Field of Classification Search

CPC .. A61H 1/0222; A61H 1/0237; A61H 1/0292; A61H 1/0296; A61H 7/002; A61H 2201/1261; A61H 2201/1269; A61H 2201/1623; A61H 2201/164; A61H 2205/04; A61H 2205/081; A63B 21/00128

See application file for complete search history.

(56) References Cited

U.S. PATENT DOCUMENTS

| | | | | |
|---|---|---|---|---|
| 4,717,146 | A * | 1/1988 | Nohara | A63B 21/00178 482/62 |
| 4,976,426 | A * | 12/1990 | Szabo | A63B 21/00178 482/111 |
| 5,665,038 | A * | 9/1997 | Miller | A63B 21/078 482/104 |
| 5,823,921 | A * | 10/1998 | Dawson | A63B 21/00181 482/104 |
| 9,011,301 | B2 * | 4/2015 | Balandis | A63B 21/0056 482/115 |
| 2005/0101462 | A1 * | 5/2005 | Atwell | A63B 21/4045 482/142 |
| 2014/0364281 | A1 * | 12/2014 | Moschel | A63B 22/0012 482/80 |

* cited by examiner

*Primary Examiner* — Timothy A Stanis
(74) *Attorney, Agent, or Firm* — Bruce Stone LLP; Joseph A. Bruce

(57) ABSTRACT

A massage and stretch bench includes: a body with a top plate and a plurality of supports, the top plate including a first positioning hole opening in a vertical direction, and each of the supports being mounted on the bottom surface and provided with an opening; a baseplate inserted along the horizontal direction into the openings of the plurality of supports and having a second positioning hole which is aligned with the first positioning hole and opens in the vertical direction; an upright post inserted along the vertical direction into the first and second positioning holes; and a footrest including a first footrest piece, a second footrest piece and two connecting pieces connected between the first and second footrest pieces so as to define a baseplate-insertion slot which opens in the horizontal direction, and the baseplate is inserted in the baseplate-insertion slot.

10 Claims, 10 Drawing Sheets

MASSAGE AND STRETCH BENCH

BACKGROUND

Field of the Invention

The present invention relates to a massage tool, and more particularly to a massage and stretch bench.

Related Prior Art

After working out, people usually lie on the bed or floor and put their feet up against the wall, so that they can stretch their legs to prevent delayed onset muscle soreness. However, some users want to keep the bed clean and don't choose to stretch on the bed, and some users refuse to stretch legs on the floor, so they find no places to do the leg stretching.

Some users do sit ups at home, and in order to fix their feet, they have to buy a sit-up equipment. However, this sit-up equipment is only useful for users to do sit ups and takes space, and most users don't like to buy it.

The present invention has arisen to mitigate and/or obviate the afore-described disadvantages.

SUMMARY

One objective of the present invention is to provide an equipment suitable for the user to do stretching or exercise and solve the problem that the user find no appropriate place to stretch legs.

To achieve the above objective, a massage and stretch bench provided by the invention comprises:

a body with a top plate and a plurality of supports, the top plate including a bottom surface, and a first positioning hole opening in a vertical direction, each of the supports being mounted on the bottom surface and provided with an opening which opens in a horizontal direction;

a baseplate inserted along the horizontal direction into the openings of the plurality of supports and having a second positioning hole which is aligned with the first positioning hole and opens in the vertical direction;

an upright post inserted along the vertical direction into the first and second positioning holes; and a footrest including a first footrest piece, a second footrest piece and two connecting pieces connected between the first and second footrest pieces, so that the first footrest piece, the second footrest piece and the two connecting pieces define a baseplate-insertion slot which opens in the horizontal direction, and the baseplate is inserted in the baseplate-insertion slot.

Preferably, each of the supports includes two legs and a beam connected between the two legs, and the two legs each have one end connected to the bottom surface, so that the bottom surface, the two legs and the beam define the opening.

Preferably, the upright post is provided with an insertion hole, a pedal assembly includes a bearing, two cranks and two pedal members, the bearing is inserted in the insertion hole, and the two cranks each have one end connected to two sides of the bearing and another end connected to the two pedal members, respectively.

Preferably, a massage means which includes a base, a positioning shaft and two wheels, the base includes two lateral walls, a first bottom wall and a second bottom wall, each of the first and second bottom walls has two ends connected to the two lateral walls, respectively, so that the two lateral walls and the first and second bottom walls define a top-plate-insertion slot which opens in the horizontal direction to allow the base to be sleeved onto the top plate via the top-plate-insertion slot, the second bottom wall is abutted against the bottom surface, the first bottom wall is abutted against the top surface, the first bottom wall is provided with a connecting slot which opens in the vertical direction, each of the two lateral walls is provided at one end thereof with a positioning notch, the two positioning notches are aligned with each other, the positioning shaft has two ends inserted in the two positioning notches and is provided with a plurality of positioning protrusions sequentially arranged along an axial direction of the positioning shaft, each of the two wheels is provided with a positioning cavity for engaging with the positioning protrusions.

Preferably, two pedals assembled to two opposite lateral sides of the top plate and located at one end of the top plate close to the footrest, each of the two pedals has a connecting shaft and a pedal portion to be pushed by a user's feet, each of the connecting shafts has one end inserted in a corresponding one of the pedal portions and another end inserted in one of the lateral sides of the top plate.

Preferably, two handles assembled to two opposite lateral sides of the top plate and located at one end of the top plate opposite the footrest, the two handles each include a gripping portion and an insertion portion which extends from the gripping portion and is inserted in one of the two lateral sides of the top plate, so as to fix the handles to the lateral sides of the top plate.

Preferably, a cushioning means disposed on the top surface of the top plate, and includes: a bottom fabric and three massage balls disposed on one surface of the bottom fabric, and another surface of the bottom fabric is adhered to the top surface.

By such arrangements, the user can stretch legs, do sit ups, pedaling exercise, etc on the massage and stretch bench of the invention, and the massage means can massage the user's neck or back, which provides an equipment suitable for the user to do stretching and solves the problem that the user find no appropriate place to stretch legs.

The user can also stretch his/her body with the aid of the two pedals and the two handles, and can massage his/her back with the cushioning means. Hence, the massage and stretch bench of the invention can be used in different ways to stretch and massage different parts of the user's body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
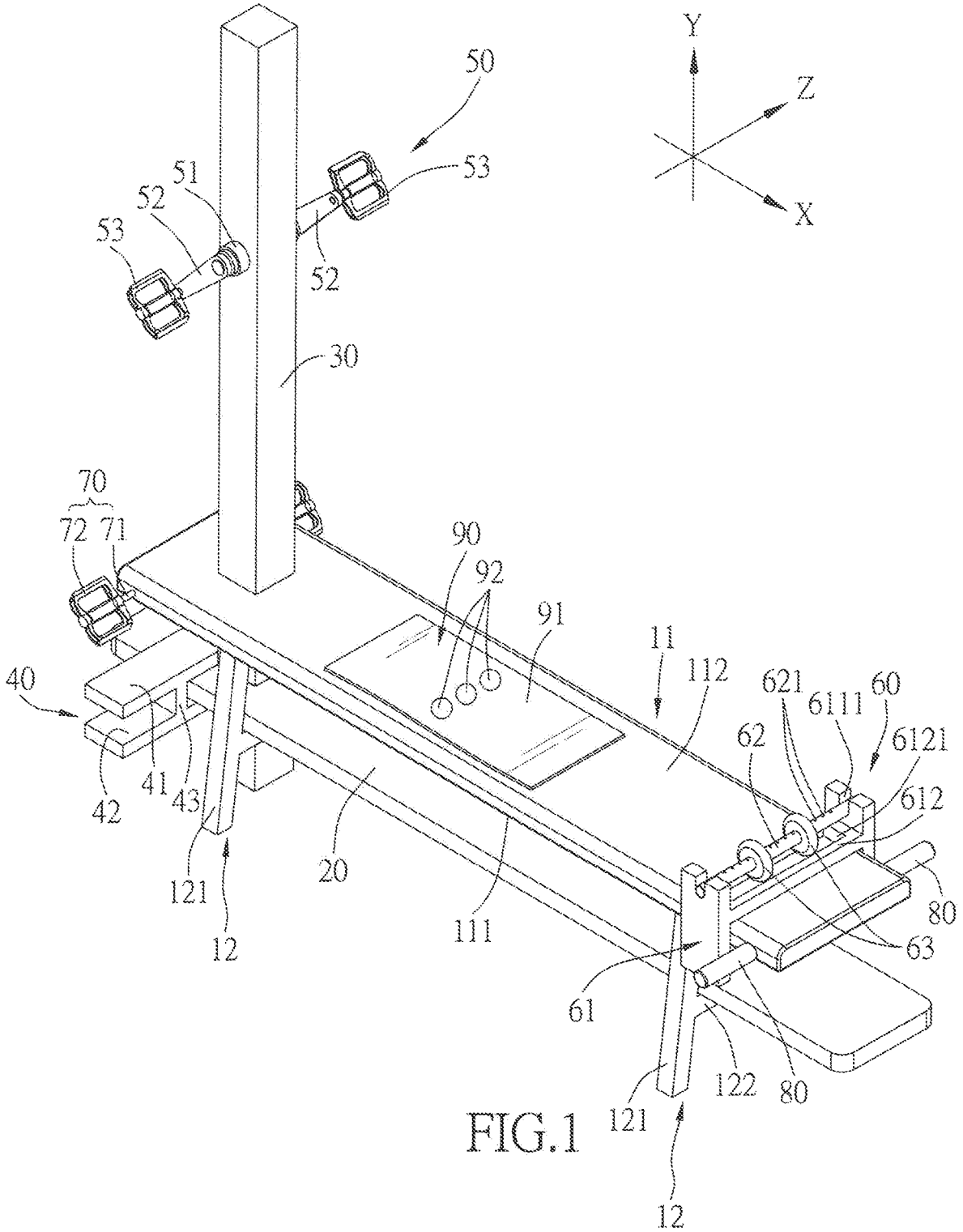
FIG. 1 is an assembly view of a massage and stretch bench in accordance with a preferred embodiment of the invention.
Figure 2:
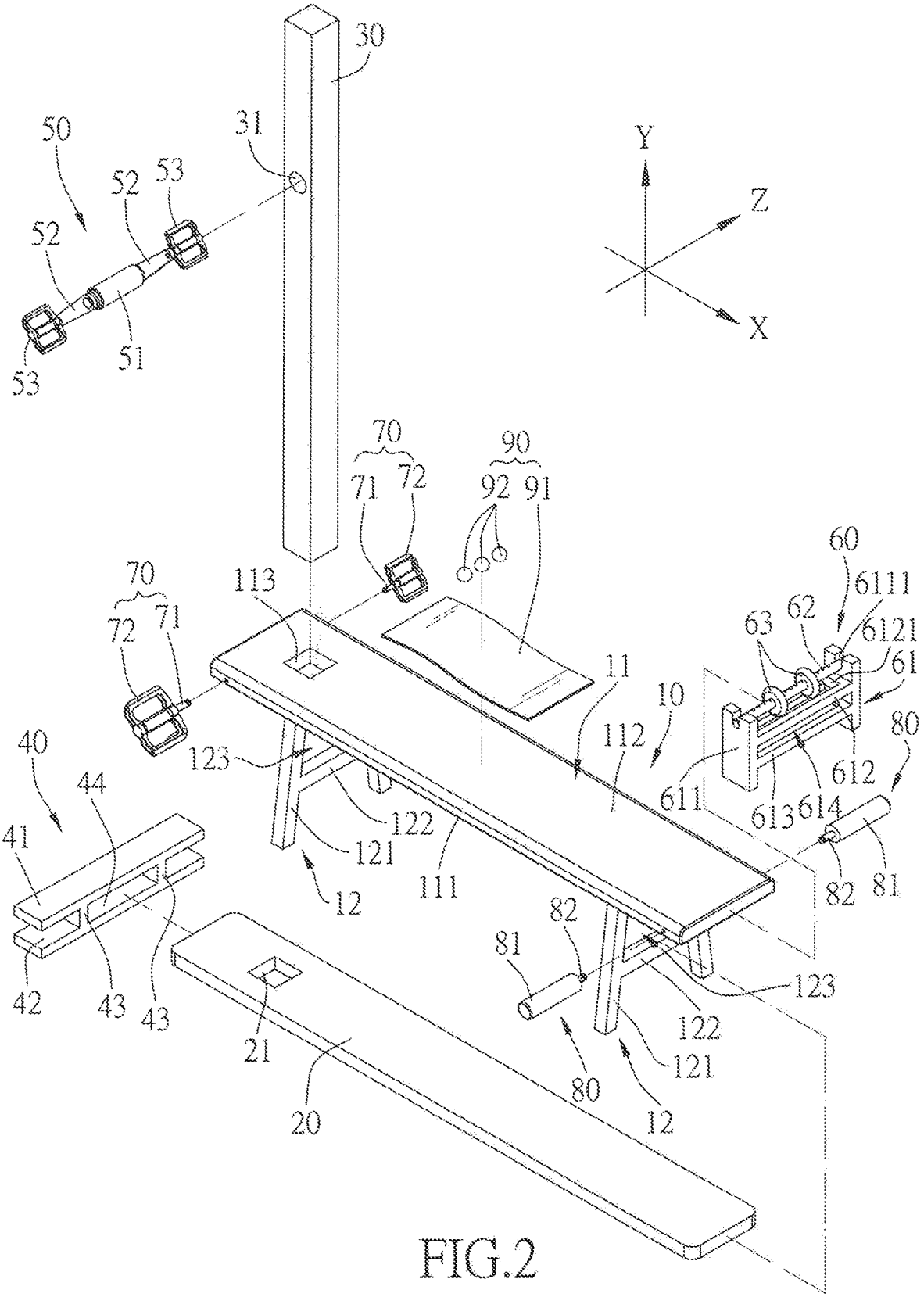
FIG. 2 is an exploded view of the massage and stretch bench in accordance with the preferred embodiment of the invention.
Figure 3:
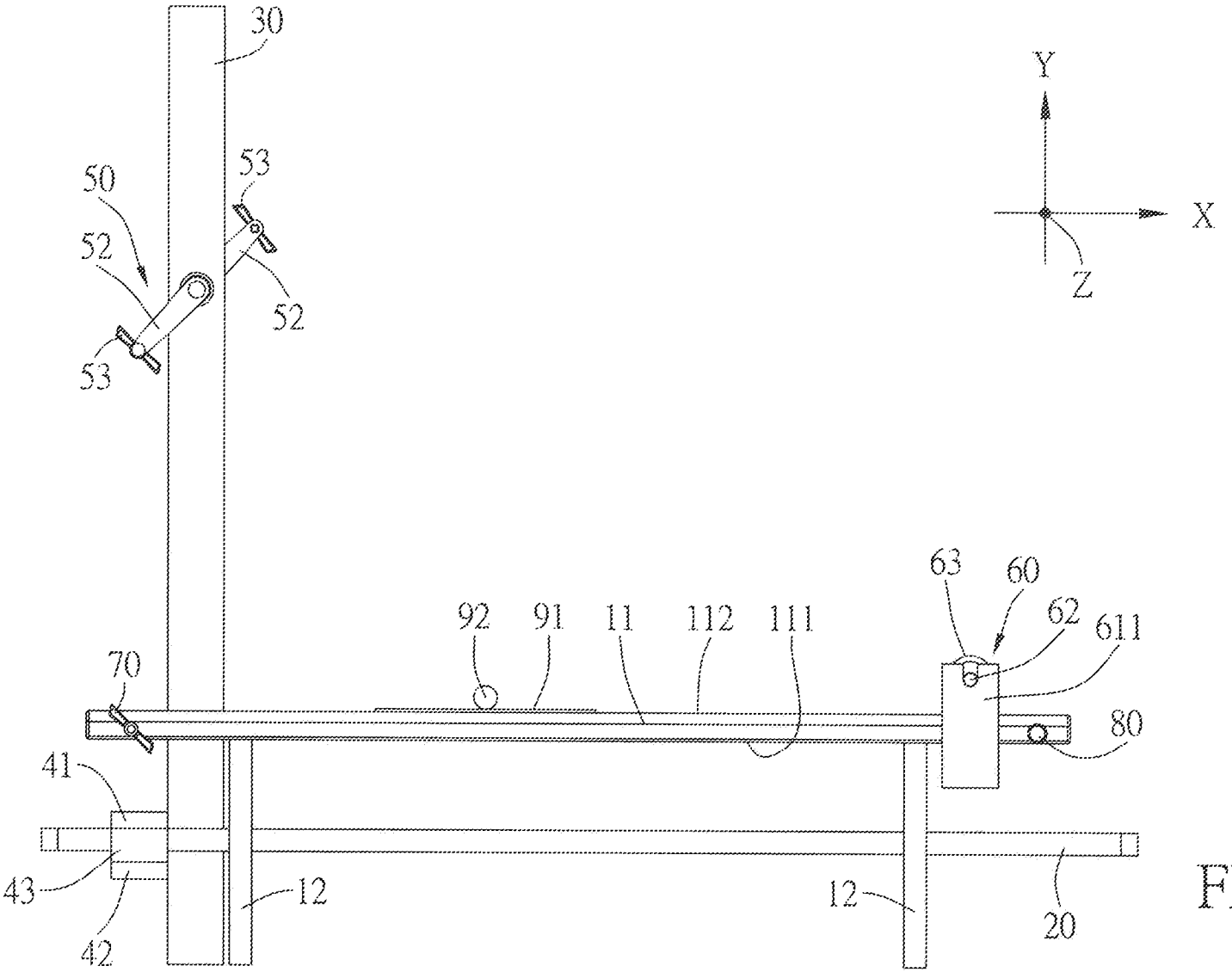
FIG. 3 is a side view of the massage and stretch bench in accordance with the preferred embodiment of the invention.
Figure 4:
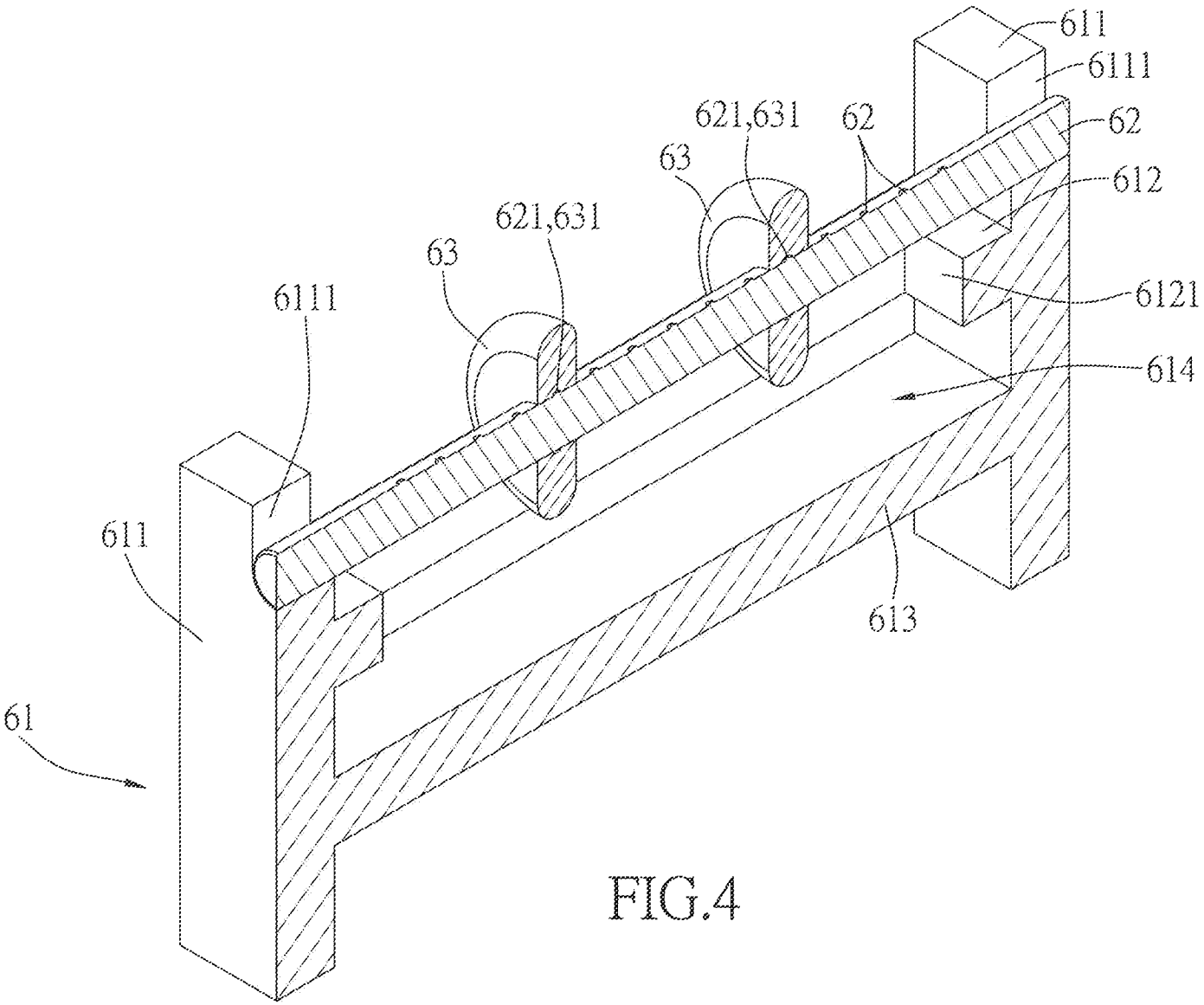
FIG. 4 is a cross sectional view of the massage and stretch bench in accordance with the preferred embodiment of the invention.

The present invention will be clearer from the following description when viewed together with the accompanying drawings, which show, for purpose of illustrations only, the preferred embodiment in accordance with the present invention.

Referring to FIGS. 1-4, a massage and stretch bench in accordance with the preferred embodiment of the invention comprises: a body 10, a baseplate 20, an upright post 30, a footrest 40, a pedal assembly 50, a massage means 60, two pedals 70, two handles 80, and a cushioning means 90.

The body 10 includes a top plate 11 and two supports 12. The top plate 11 includes a bottom surface 111, a top surface 112, and a first positioning hole 113 opening in a vertical direction Y. Each of the supports 12 includes two legs 121 and a beam 122 connected between the two legs 121. The two legs 121 each have one end connected to the bottom surface 111, so that the bottom surface 111, the two legs 121 and the beam 122 define an opening 123 which opens in a horizontal direction X perpendicular to the vertical direction Y.

The baseplate 20 is inserted along the horizontal direction X into the openings 123 of the two supports 12 and placed on the two beams 122. The baseplate 20 includes a second positioning hole 21 which is aligned with the first positioning hole 113 and opens in the vertical direction Y.

The upright post 30 is inserted along the vertical direction Y into the first and second positioning holes 113, 21, and provided with an insertion hole 31 opens in a depth direction Z.

The footrest 40 includes a first footrest piece 41, a second footrest piece 42 and two connecting pieces 43 connected between the first and second footrest pieces 41, 42. The first footrest piece 41, the second footrest piece 42 and the two connecting pieces 43 define a baseplate-insertion slot 44 which opens in the horizontal direction X, and the footrest 40 is inserted on the baseplate 20 via the baseplate-insertion slot 44.

The pedal assembly 50 includes a bearing 51, two cranks 52 and two pedal members 53. The bearing 51 is inserted in the insertion hole 31. The two cranks 52 each have one end connected to two sides of the bearing 51 and another end connected to the two pedal members 53, respectively.

The massage means 60 includes a base 61, a positioning shaft 62 and two wheels 63. The base 61 includes two lateral walls 611, a first bottom wall 612 and a second bottom wall 613 which have two ends connected to the two lateral walls 611, respectively, so that the two lateral walls 611 and the first and second bottom walls 612, 613 define a top-plate-insertion slot 614 which opens in the horizontal direction X to allow the base 61 to be sleeved onto the top plate 11 via the top-plate-insertion slot 614, in such a manner that the second bottom wall 613 is abutted against the bottom surface 111, and the first bottom wall 612 is abutted against the top surface 112. The first bottom wall 612 is provided with a connecting slot 6121 which opens in the vertical direction Y, and each of the two lateral walls 611 is provided at one end thereof with a positioning notch 6111, and the two positioning notches 6111 are aligned with each other.

The positioning shaft 62 has two ends inserted in the two positioning notches 6111, and is provided with a plurality of positioning protrusions 621 sequentially arranged along an axial direction of the positioning shaft 62.

Each of the two wheels 63 is provided with a positioning cavity 631 for engaging with the positioning protrusions 621. The two wheels 63 will be partially located within the connecting slot 6121 when sleeved onto the positioning shaft 62.

The two pedals 70 are assembled to two opposite lateral sides of the top plate 11 and located at one end of the top plate 11 close to the footrest 40. Each of the two pedals 70 has a connecting shaft 71 and a pedal portion 72 to be pushed by the user's feet. Each of the connecting shafts 71 has one end inserted in a corresponding one of the pedal portions 72 and another end inserted in one of the lateral sides of the top plate 11.

The two handles 80 are assembled to the two opposite lateral sides of the top plate 11 and located at another end of the top plate 11 opposite the footrest 40. The two handles 80 are cylindrical-shaped and each include a gripping portion 81 and an insertion portion 82 which extends from the gripping portion 81 and is inserted in one of the two lateral sides of the top plate 11, so as to fix the handles 80 to the lateral sides of the top plate 11.

The cushioning means 90 is disposed on the top surface 112 of the top plate 11, and includes: a bottom fabric 91 and three massage balls 92 disposed on one surface of the bottom fabric 91. The bottom fabric 91 has another surface adhered to the top surface 112.

Figure 9:
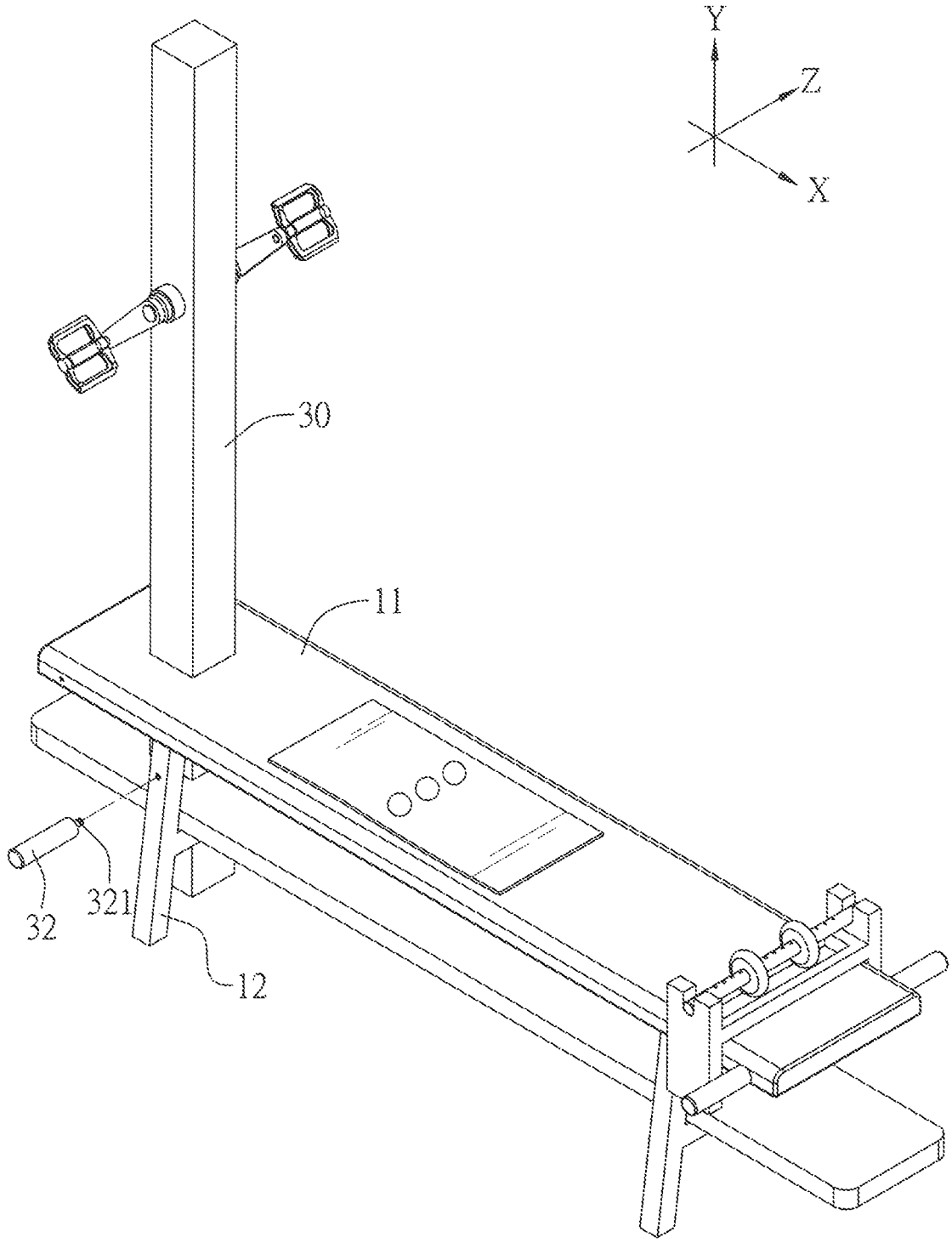
FIG. 9 is an exploded view of the massage and stretch bench in accordance with another preferred embodiment of the invention.

Referring to FIG. 9, a massage and stretch bench in accordance with another preferred embodiment of the invention is not provided with the footrest 40. One of the supports 12 adjacent to the upright post 30 is provided with two footrest pins 32 which are fixed at two sides of the support 12 and extend in the depth direction Z. Each of the footrest pins 32 has a first connecting protrusion 321 inserted in the footrest 12, so that the user can lie on the top plate 11 with feet resting on the footrest pins 32.

Figure 10:
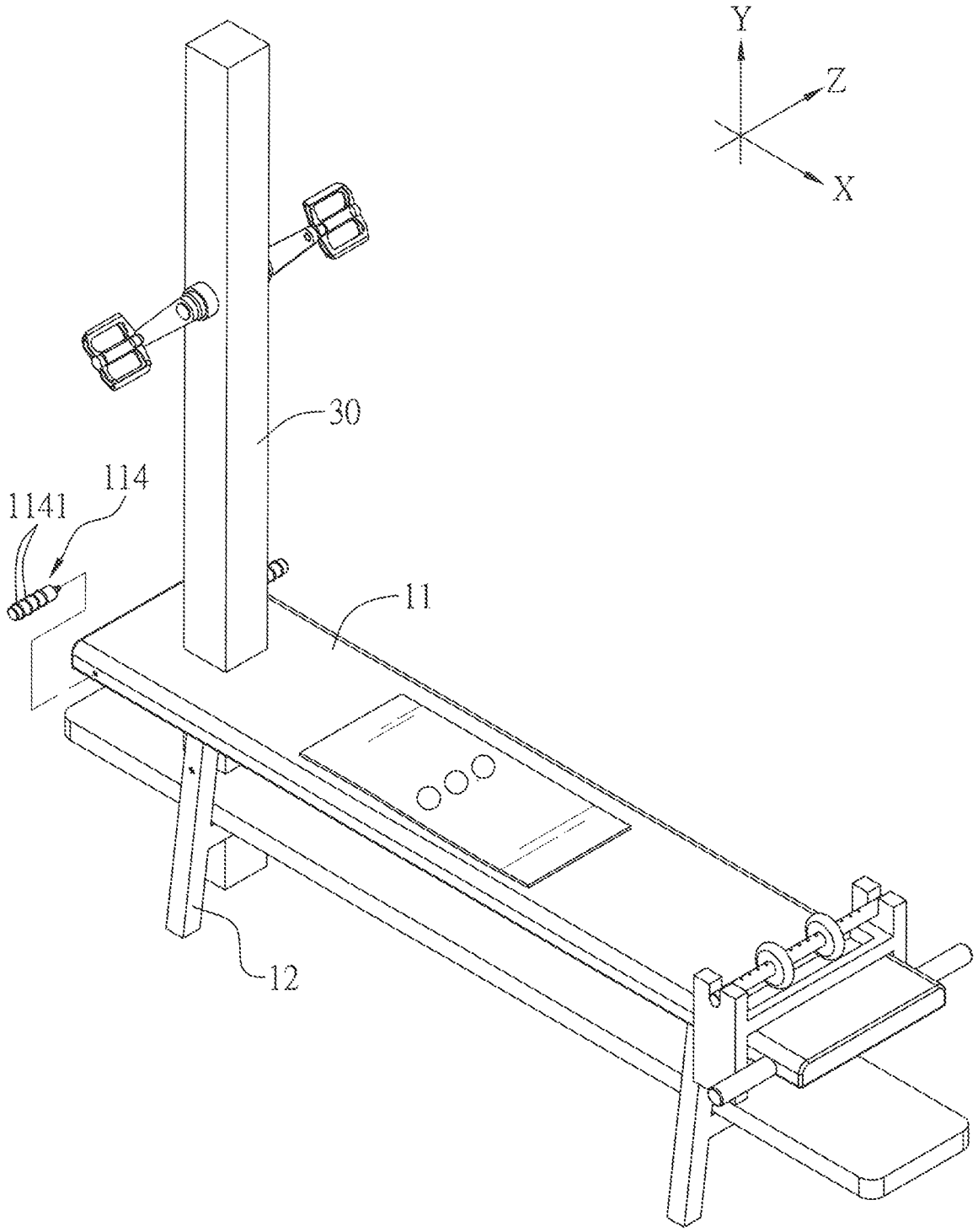
FIG. 10 is an exploded view of the massage and stretch bench in accordance with another preferred embodiment of the invention.

Referring to FIG. 10, a massage and stretch bench in accordance with another preferred embodiment of the invention is not provided with the two pedals 70. One end of the top plate 11 adjacent to the upright post 30 is provided with two massage rods 114 which fixed at two sides of the top plate 11 and extend along the depth direction Z. Each of the massage rods 114 is provided with a plurality of massage rings 1141 formed around the outer periphery of the massage rods 114, so that when the user lies on the top plate 11 with feet resting on the massage rods 114, the massage rings 1141 can massage the user's feet.

What mentioned above are the structural relations of the respective components of the embodiment, and the operation of the invention is explained as follows.

Figure 5:
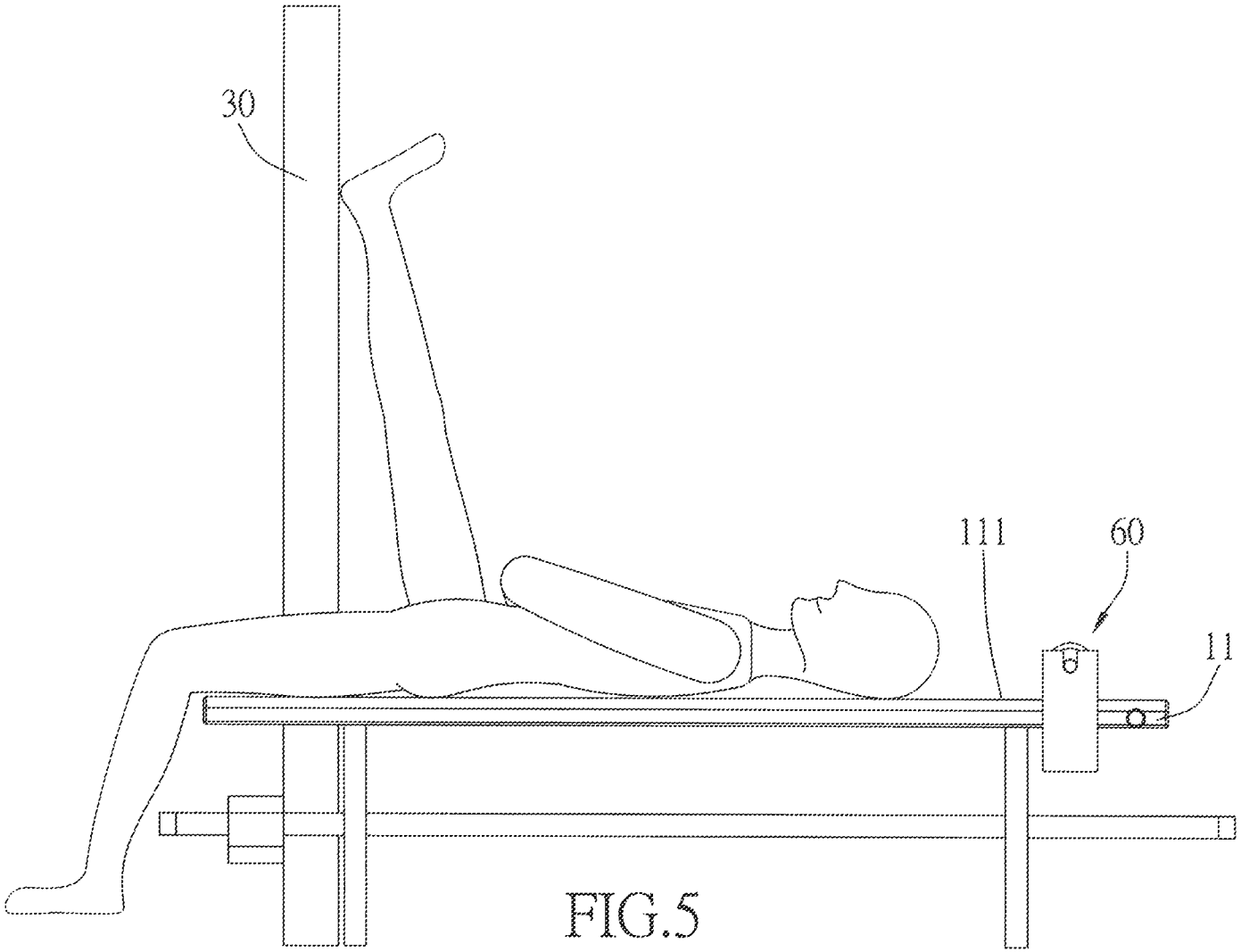
FIG. 5 is an illustrative view showing that a user is stretching legs by using the massage and stretch bench in accordance with the preferred embodiment of the invention.

Referring to FIG. 5, the user can lie on the top surface 112 of the top plate 11 and put one leg up against the upright post 30 when want to stretch legs. With the top plate 11 and the upright post 30, the user does not have to lie on the ground, nor have to find a place to put up legs, which is not only convenient for the user to put up legs but also provides a clean place for the user to stretch legs.

Figure 6:
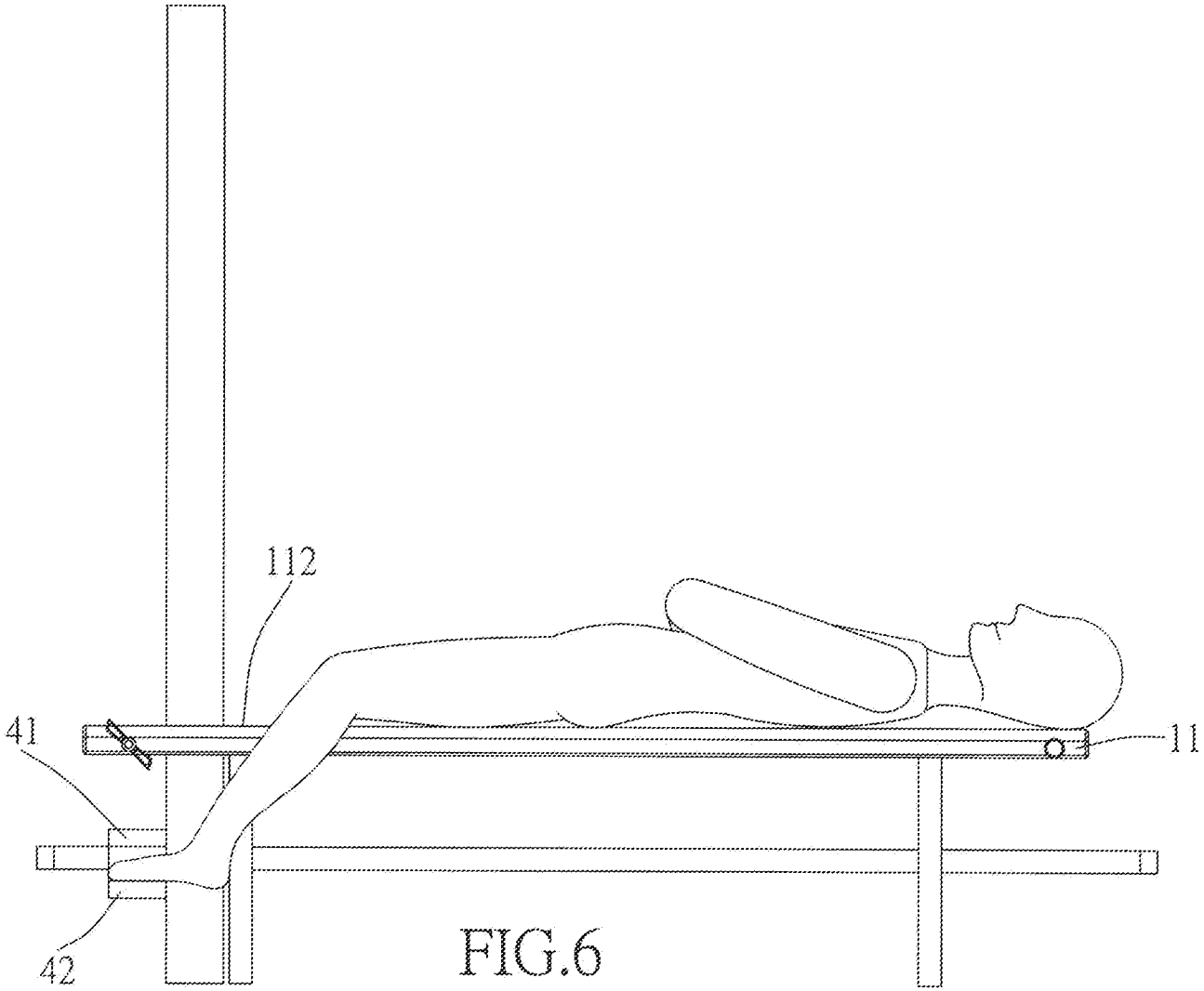
FIG. 6 is an illustrative view showing that a user is doing sit ups by using the massage and stretch bench in accordance with the preferred embodiment of the invention.

Referring then to FIG. 6, when want to do sit ups, the user can lie on the top surface 112 of the top plate 11 and put feet on the second footrest piece 42, so that the first and second footrest pieces 41, 42 can fix the users' feet to allow the user to do sit ups.

Figure 7:
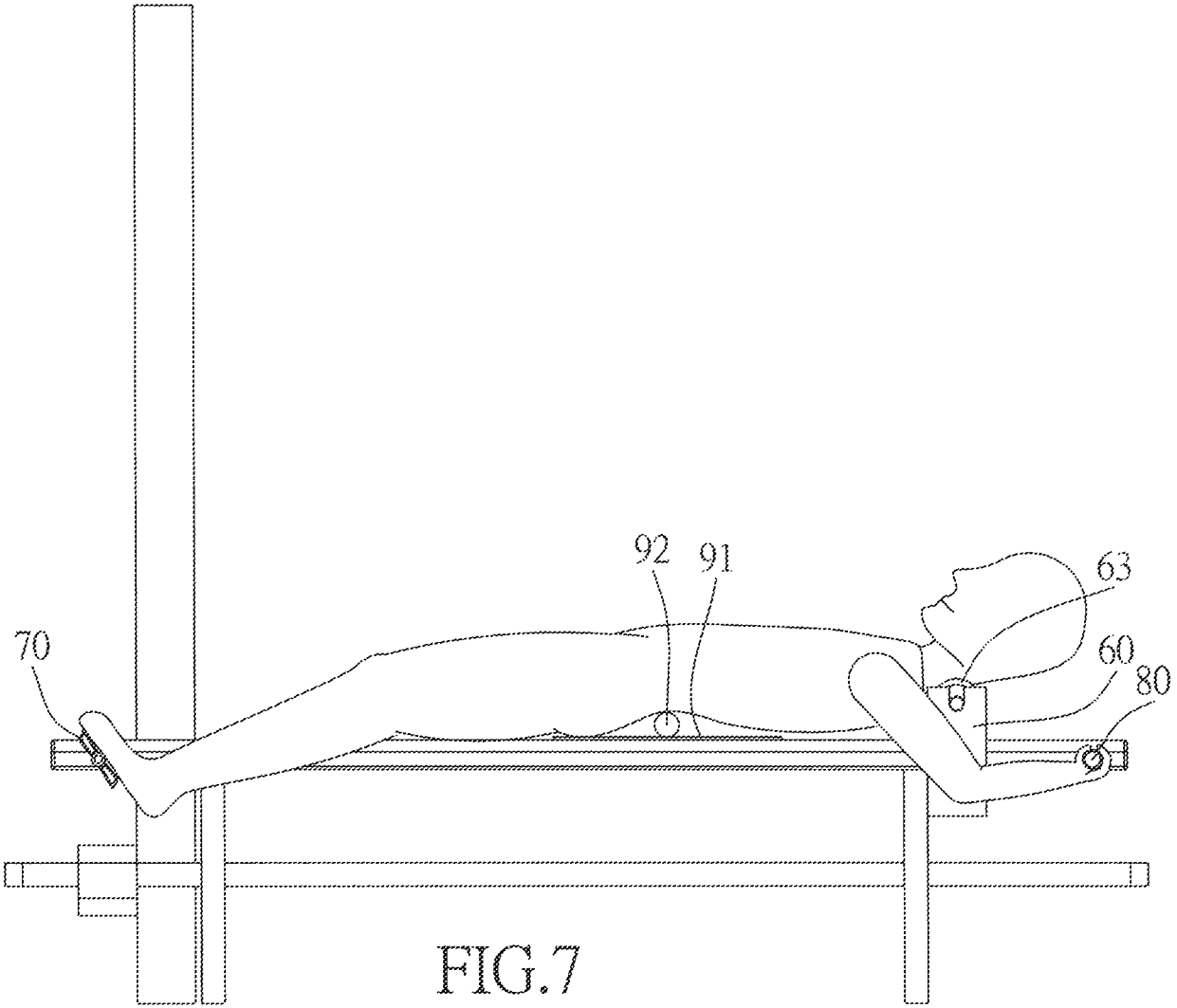
FIG. 7 is an illustrative view showing that a user is massaged by the massage and stretch bench in accordance with the preferred embodiment of the invention.

Referring then to FIG. 7, the user can put his/her neck between the two wheels 63, then the wheels 63 roll to massage the user's neck. Meanwhile, the user can grip the gripping portions 81 of the two handles 80 with two hands, and put feet onto the two pedals 70, which provides support points for the user's hands and feet, so that the user can stretch his body completely. At the meantime, the user's back is positioned on the cushioning means 90 and massaged by the three massage balls 92.

Figure 8:
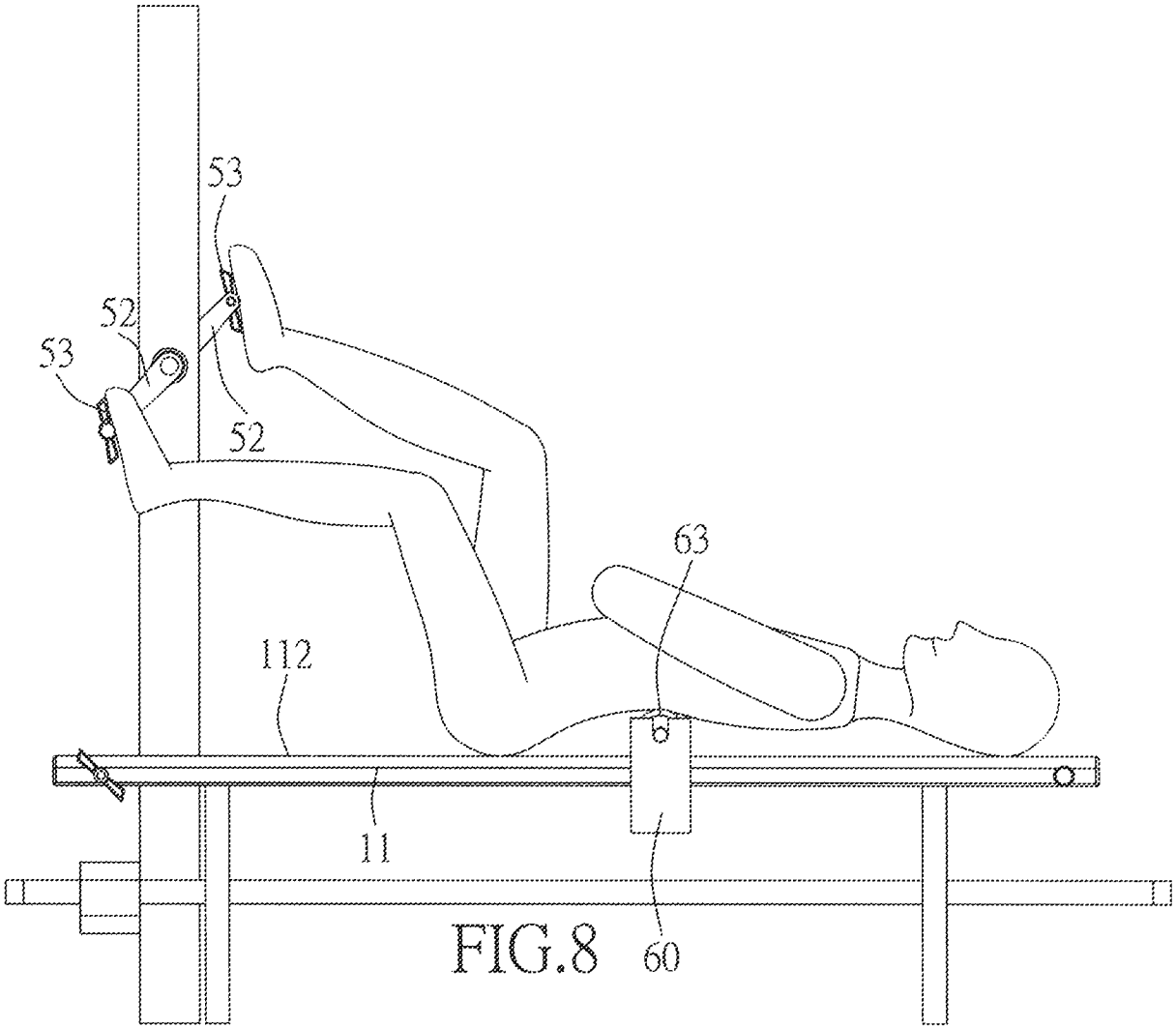
FIG. 8 is an illustrative view showing that a user is doing pedalling exercise by using the massage and stretch bench in accordance with the preferred embodiment of the invention.

Referring finally to FIG. 8, the user can also lie on the top surface 112 of the top plate 11 while push the two pedal members 53 with feet to do pedaling exercise. Preferably, the user can also has his/her back positioned on the two wheels 63, so that the wheels 63 can massage the user's back.

By such arrangements, the user can stretch legs, do sit ups, pedaling exercise, etc on the massage and stretch bench of the invention, and the massage means 60 can massage the user's neck or back, which provides an equipment suitable for the user to do stretching and solves the problem that the user find no appropriate place to stretch legs.

The user can also stretch his/her body with the aid of the two pedals 70 and the two handles 80, and can massage his/her back with the cushioning means 90. Hence, the massage and stretch bench of the invention can be used in different ways to stretch and massage different parts of the user's body.

While we have shown and described various embodiments in accordance with the present invention, it is clear to those skilled in the art that further embodiments may be made without departing from the scope of the present invention.

What is claimed is:

1. A massage and stretch bench, comprising:

a body with a top plate and a plurality of supports, the top plate including a bottom surface, and a first positioning hole opening in a vertical direction, each of the supports being mounted on the bottom surface and provided with an opening which opens in a horizontal direction;

a baseplate inserted along the horizontal direction into the openings of the plurality of supports and having a second positioning hole which is aligned with the first positioning hole and opens in the vertical direction;

an upright post inserted along the vertical direction into the first and second positioning holes; and a footrest including a first footrest piece, a second footrest piece and two connecting pieces connected between the first and second footrest pieces, so that the first footrest piece, the second footrest piece and the two connecting pieces define a baseplate-insertion slot which opens in the horizontal direction, and the baseplate is inserted in the baseplate-insertion slot.

2. The massage and stretch bench as claimed in claim 1, wherein each of the supports includes two legs and a beam connected between the two legs, and the two legs each have one end connected to the bottom surface, so that the bottom surface, the two legs and the beam define the opening.

3. The massage and stretch bench as claimed in claim 1, wherein the upright post is provided with an insertion hole, a pedal assembly including a bearing, two cranks and two pedal members, the bearing is inserted in the insertion hole, and the two cranks each have one end connected to two sides of the bearing and another end connected to the two pedal members, respectively.

4. The massage and stretch bench as claimed in claim 1 further comprising a massage means which includes a base, a positioning shaft and two wheels, the base includes two lateral walls, a first bottom wall and a second bottom wall, each of the first and second bottom walls has two ends connected to the two lateral walls, respectively, so that the two lateral walls and the first and second bottom walls define a top-plate-insertion slot which opens in the horizontal direction to allow the base to be sleeved onto the top plate via the top-plate-insertion slot, the second bottom wall is abutted against the bottom surface, the first bottom wall is abutted against the top surface, the first bottom wall is provided with a connecting slot which opens in the vertical direction, each of the two lateral walls is provided at one end thereof with a positioning notch, the two positioning notches are aligned with each other, the positioning shaft has two ends inserted in the two positioning notches and is provided with a plurality of positioning protrusions sequentially arranged along an axial direction of the positioning shaft, each of the two wheels is provided with a positioning cavity for engaging with the positioning protrusions.

5. The massage and stretch bench as claimed in claim 1 further comprising two pedals assembled to two opposite lateral sides of the top plate and located at one end of the top plate close to the footrest, each of the two pedals has a connecting shaft and a pedal portion to be pushed by a user's feet, each of the connecting shafts has one end inserted in a corresponding one of the pedal portions and another end inserted in one of the lateral sides of the top plate.

6. The massage and stretch bench as claimed in claim 1 further comprising two handles assembled to two opposite lateral sides of the top plate and located at one end of the top plate opposite the footrest, the two handles each include a gripping portion and an insertion portion which extends from the gripping portion and is inserted in one of the two lateral sides of the top plate, so as to fix the handles to the lateral sides of the top plate.

7. The massage and stretch bench as claimed in claim 1 further comprising a cushioning means disposed on the top surface of the top plate, and includes: a bottom fabric and three massage balls disposed on one surface of the bottom fabric, and another surface of the bottom fabric is adhered to the top surface.

8. The massage and stretch bench as claimed in claim 1 further comprising two massage rods disposed at two sides of the top plate and located adjacent to one end of the top plate adjacent to the upright post, and each of the massage rods is provided with a plurality of massage rings formed around an outer periphery of the massage rods.

9. A massage and stretch bench, comprising:

a body with a top plate and a plurality of supports, the top plate including a bottom surface, and a first positioning hole opening in a vertical direction, each of the supports being mounted on the bottom surface and provided with an opening which opens in a horizontal direction;

a baseplate inserted along the horizontal direction into the openings of the plurality of supports and having a second positioning hole which is aligned with the first positioning hole and opens in the vertical direction;

an upright post inserted along the vertical direction into the first and second positioning holes; and two footrest pins fixed at two sides of one of the supports adjacent to the upright post, and each of the footrest pins has a first connecting protrusion inserted in the one of the supports.

10. The massage and stretch bench as claimed in claim 9 further comprising two massage rods disposed at two sides of the top plate and located adjacent to one end of the top plate adjacent to the upright post, and each of the massage rods is provided with a plurality of massage rings formed around an outer periphery of the massage rods.

* * * * *